United States Patent [19]

Duran

[11] 4,121,444

[45] Oct. 24, 1978

[54] MANUALLY OPERABLE TOOL FOR INSTALLING BLIND ANCHOR NUTS

[75] Inventor: John A. Duran, Glendora, Calif.

[73] Assignee: Avibank Mfg., Inc., Burbank, Calif.

[21] Appl. No.: 786,084

[22] Filed: Apr. 11, 1977

[51] Int. Cl.[2] ..... B21J 15/34

[52] U.S. Cl. ..... 72/114

[58] Field of Search ..... 72/391, 114; 81/55, 81/56, 53

[56] References Cited

U.S. PATENT DOCUMENTS

| | | | |
|---|---|---|---|
| 2,562,419 | 7/1951 | Ferris | 72/391 |
| 3,462,988 | 8/1969 | Tudor | 72/391 |
| 3,587,271 | 3/1969 | Rigot | 72/114 |
| 3,659,449 | 5/1972 | Abernathy | 72/391 |

*Primary Examiner*—Lowell A. Larson
*Assistant Examiner*—Gene P. Crosby
*Attorney, Agent, or Firm*—Poms, Smith, Lande & Glenny

[57] ABSTRACT

A manually operable tool for installing blind anchor nuts by pulling an internally threaded part of the nut into a body part of the nut to expand the latter. The tool includes a body member having a bore extending therethrough, an anvil at one end of the bore for engaging the body part of an anchor nut, the anvil surrounding an aperture aligned with the bore, and a grip by means of which an operator can hold the body member to prevent rotation thereof about the bore. A mandrel, which may be changed without the need for external tooling, is positioned in the aperture in the anvil, the mandrel having an externally threaded portion extending outwardly of the anvil and a socket facing into the bore. A shaft is rotatable and reciprocable in the bore of the body member which shaft is provided at one end with a key which fits into the socket on the mandrel in driving engagement therewith, the key being interchangeable without the need for external tooling. The shaft is provided with a handle outside the body member of the tool by means of which the shaft can be both rotated and reciprocated with respect to the body member, the shaft being reciprocable between a first position in which key on the shaft engages in the socket on the mandrel thereby allowing rotation of the mandrel by means of the handle, and a second position in which the key disengages from the socket thereby allowing rotation of the handle without rotation of the mandrel.

17 Claims, 10 Drawing Figures

10
11
12
13
14
15
16
20
21
22
23
24
25
26
30
32
35
36
37
38
39
41
42
44
45
46
47
48
III
III

MANUALLY OPERABLE TOOL FOR INSTALLING BLIND ANCHOR NUTS

BACKGROUND OF THE INVENTION

1. Field of the Invention

The invention relates to tools for installing blind anchor nuts, and, more particularly, to manually operable tools for installing blind anchor nuts.

2. Description of the Prior Art

In U.S. Pat. No. 3,587,271 to Rigot, there is described a tool for installing blind anchor nuts. In that patent, "blind anchor nuts" are defined by a device comprising a tubular body portion and an internally threaded nut portion, the nut portion being capable of being pulled towards the tubular body portion to deform the body portion to tightly grip the walls of a suitable aperture in which the body portion is inserted, thereby to install the anchor nut securely in the aperture. The anchor nut is "blind" in that its installation requires access to one side only of the aperture. One example of such a blind anchor nut is that widely sold under the Registered Trade Mark "NUTSERT."

Such tool requires different sized components for the particular blind anchor nuts to be installed. For example, in the Rigot patent, an annular anvil 13 is described containing therein a mandrel 17 for engaging the anchor nut to be installed. Such anvil 13 and mandrel 17 is adapted to be changed when desired so that the threaded portion 18 of mandrel 17 can theadably engage the anchor nut. Thus, when used with anchor nuts of differing internal thread diameters, members 13 and 17 must be changed. In the Rigot patent, this is accomplished by a small retaining screw 26 which engages anvil 13. By loosening screw 26, anvil 13 can be removed and both mandrel 17 and anvil 13 replaced by a mandrel 17 and anvil 13 of the proper dimensions.

In addition, when replacing mandrel 17, the key 24 of Rigot must also be replaced. In Rigot, this is accomplished by another small set screw 31 engaging key 24. In both cases, it takes time to find the proper tool to loosen the screws 26 and 31. Such screws may be allen screws thus requiring a particular type of tool to loosen the same, such as an allen wrench. Since such screws by their very nature are extremely small, there is a strong possibility of losing the same making further use of the tool impossible until a replacement is found.

In addition to being time-consuming, the torque encountered in using the Rigot tool could break off the small screws 26, 31 requiring such screws to be drilled out or otherwise removed before the tool could be used again.

It is thus necessary to have a manually operable tool for installing blind anchor nuts which does not require any external tools to change the components thereof necessary to installing anchor nuts of different sizes.

SUMMARY OF THE INVENTION

It is an object of this invention to provide a tool for installing blind anchor nuts which is adaptable to fit anchor nuts of different sizes without the need for any tooling.

It is a further object of this invention to provide a tool for installing blind anchor nuts which includes interchangeable components which cannot shear during normal use of the tool.

It is still another object of this invention to provide a tool for installing blind anchor nuts having the stresses on the anvil equally distributed about its peripheral surface.

It is a further object of this invention to provide a tool for installing blind anchor nuts wherein the rotary shaft includes means for rotating the same by a conventional tool engaging the shaft after removing the handle on the shaft for installing blind anchor nuts in close quarters or the like.

These and other objects are preferably accomplished by providing a tool which includes a body member having a bore extending therethrough, an anvil at one end of the bore for engaging the body part of an anchor nut, the anvil surrounding an aperture aligned with the bore, and a grip by means of which an operator can hold the body member to prevent rotation thereof about the bore. A mandrel, which may be changed without the need for external tooling, is positioned in the aperture in the anvil, the mandrel having an externally threaded portion extending outwardly of the anvil and a socket facing into the bore. A shaft is rotatable and reciprocable in the bore of the body member which shaft is provided at one end with a key which fits into the socket on the mandrel in driving engagement therewith, the key being interchangeable without the need for external tooling. The shaft is provided with a handle outside the body member of the tool by means of which the shaft can be both rotated and reciprocated with respect to the body member, the shaft being reciprocable between a first position in which the key on the shaft engages in the socket on the mandrel thereby allowing rotation of the mandrel by means of the handle, and a second positon in which the key disengages from the socket thereby allowing rotation of the handle without rotation of the mandrel.

DESCRIPTION OF THE PREFERRED EMBODIMENT

Figures 1, 9, 10:
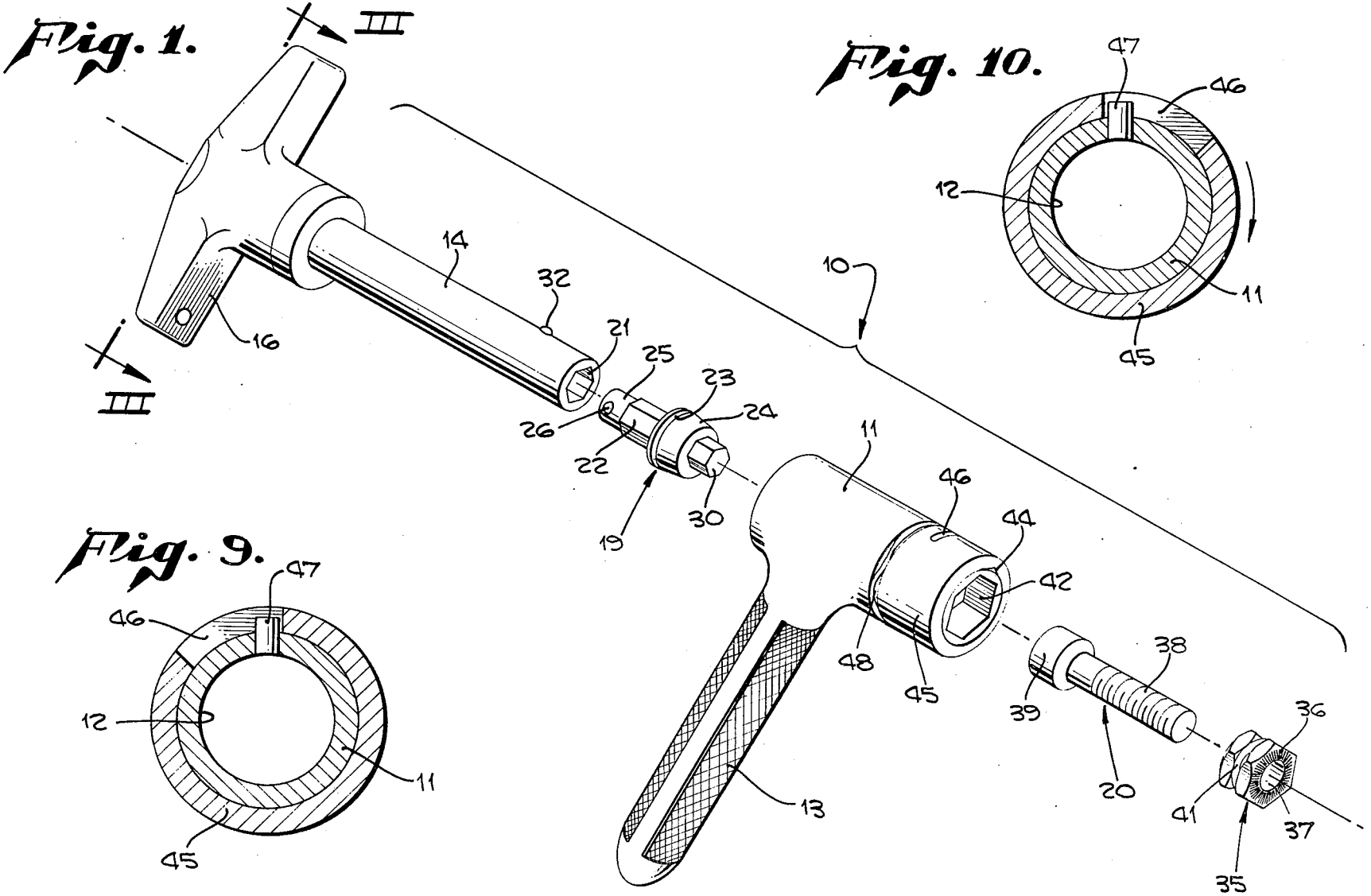
FIG. 1 is an exploded view of the tool in accordance with the teachings of my invention.
FIG. 9 is a view taken along lines IX—IX of FIG. 4.
FIG. 10 is a view taken along lines X—X of FIG. 5.
Figure 2:
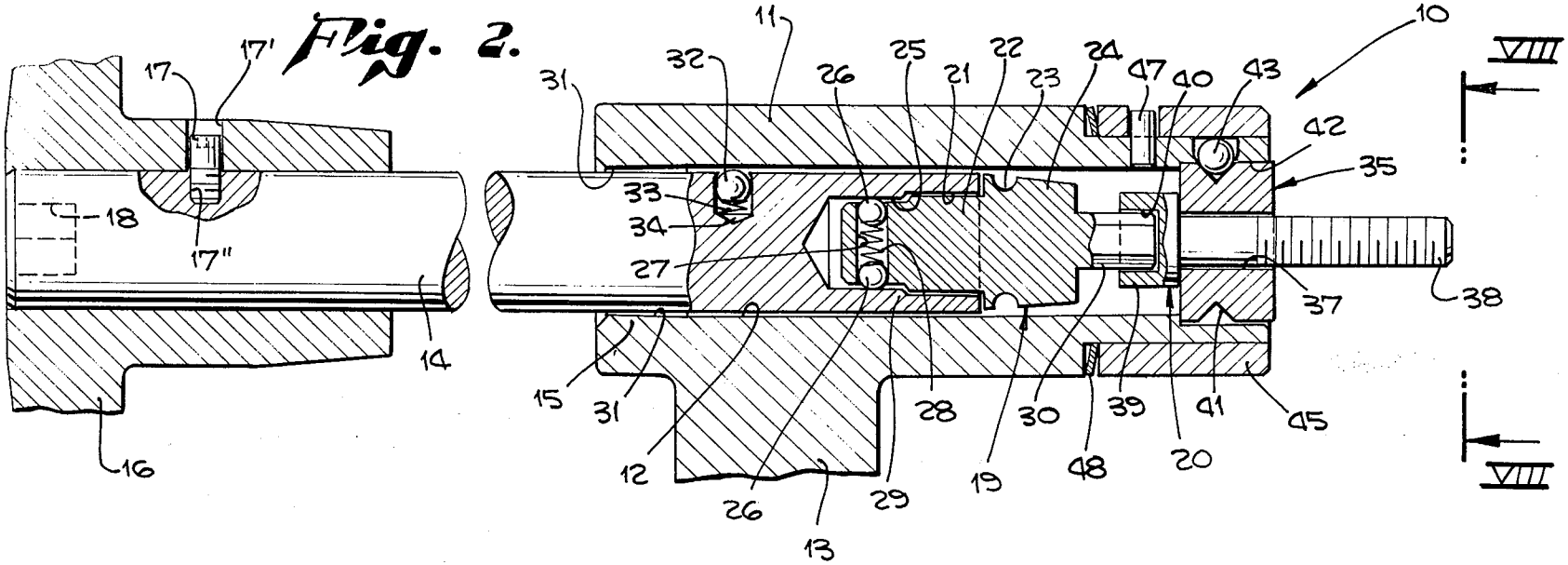
FIG. 2 is a side elevation, partially in section 1, of the tool of FIG. 1.
Figure 8:
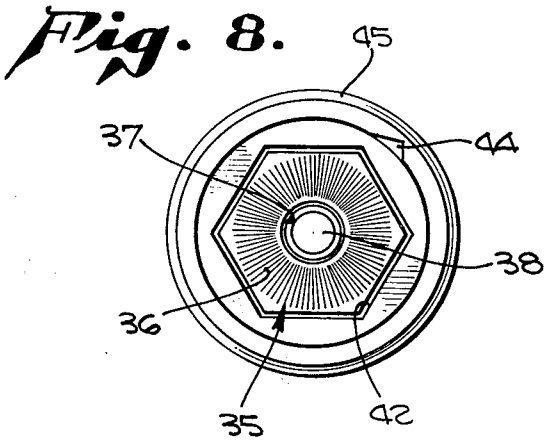
FIG. 8 is a view taken along lines VIII—VIII of FIG. 2.

As shown in FIGS. 1 and 2, tool 10 comprises a body member 11 having a bore 12 (FIG. 2) extending throughout its length. Formed integrally with the body member 11 is a grip in the form of a radially projecting handle 13 by means of which an operator can hold the body member 11 and in particular prevent rotation thereof about the bore 12.

Figure 3:
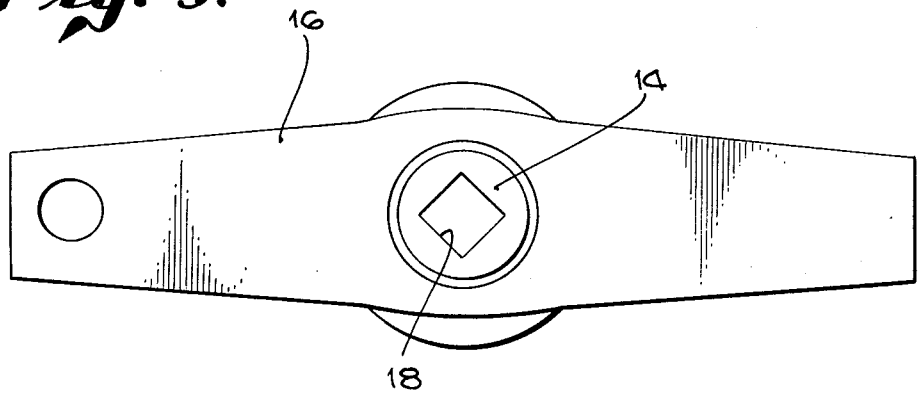
FIG. 3 is a view of the handle alone of the tool of FIG. 1 taken along lines III—III thereof.

A shaft 14 is adapted to be inserted in bore 12 and is thus reciprocable and rotatable therein. The shaft 14 is a sliding and rotating fit within an internal annular flange 15 (FIG. 2) at one end of bore 12. Shaft 14 is also provided with a Tee-shaped handle 16 outside the body member 11 of tool 10. The handle 16 preferably projects transversely on both side of the shaft 14, so that it can be used by the operator for rotating the shaft 16 and removing the shaft 14 from body member 11. If desired, handle 16 may be removably mounted on shaft 14 by means of a suitable set screw, such as an allen screw 17, threaded in a suitable apertures 17' and 17'' (FIG. 2) on handle 16 and shaft 14. Also, as shown in FIG. 3, the free end of shaft 14 may have a suitable square-shaped socket 18, such as ¼ inch square, for accepting a conventional ¼ inch square drive socket tool therein (not shown) as will also be discussed further hereinbelow.

Figure 4:
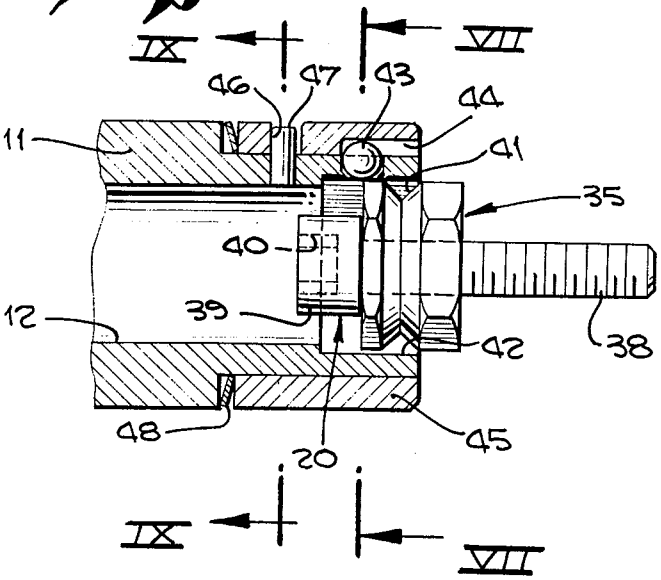
FIG. 4 is a detailed view, partly in section, of a portion of the tool of FIG. 2.

The end of shaft 14 opposite handle 16 is provided with an interchangeable key 19 adapted to fit into and drivably engage the mandrel 20 (FIG. 1). As particularly contemplated in the present invention, key 19 is adapted to be interchangeably mounted quickly and easily on shaft 14 without the need for external tooling or the like. In the exemplary embodiment of the invention, this is accomplished by providing a hexagonally shaped socket 21 in shaft 14 for receiving therein a like haxagonally shaped body portion 22 of key 19 having an annular groove 23 on the outer periphery of main body portion 24 and an integral sylindrical portion 25 adapted to enter socket 21. A pair of detent members in the form of two small locking elements (only one — element 26 — visible in FIG. 1) carried within a bore 27 (FIG. 4) in cylindrical portion 25. Elements 26 are each urged outwardly by means of a helical coil spring 28 working between them within bore 27. The metal surrounding each end of bore 27 is staked or peened over to prevent either element 26 from emerging completely from the bore 27. When the key 19 is first inserted into socket 21, the position of the elements 26 move inwardly against the bias of spring 28 until they pass shoulder 29 on the interior wall socket 21 thus restraining movement of key 19 back off of the shaft 14. When it is desired to remove key 19 so as to change the same, it is necessary for elements 26 to be retracted into bore 27 against the urging of spring 28 by the inclined face of the shoulder 29. The size and position of elements 26 and the slope of the annular shoulder 29, and the strength of spring 28, are arranged so that the operator can withdraw key 19 from socket 21 by pulling on key 19 while holding handle 16. Thus, key 19 may be removed and replaced by a different sized key. Key 24 includes a hexagonally shaped key shaft 30 (FIG. 1) extending in the direction of the bore 12 of body member 11 as will be discussed.

The outer diameter of shaft 14 is related to the diameter of bore 12 so that it can be easily inserted into bore 12. However, means are provided for releasably retaining shaft 14 within bore 12. This releasable holding means is provided by an annular tapered shoulder 31 inside of bore 12 and facing toward the right in FIG. 2. The shoulder 31 is provided by the inner face of the flange 15. Shaft 14 is also provided with detent means, such as a steel ball or locking element 32 biased by a spring 33 in a bore 34 in shaft 14 as shown in FIG. 2. Spring 33 urges locking element 32 to project outwardly away from shaft 14 but not sufficiently to contact the inner wall of the bore 12. The metal surrounding the open end of bore 34 may be staked or peened to prevent element 32 from emerging from bore 34. When shaft 14 is withdrawn from bore 12, element 32 meets the tapered annular shoulder 31 on an inclined line of contact. The abutting of element 32 against shoulder 31 restrains further movement of shaft 14 and also acts as means to releasably retain the shaft 14 within bore 12. In order to withdraw shaft 14 from bore 12, ball 32 is retracted into its bore 34 against the urging of spring 33 by the inclined face of the shoulder 31. The size and position of element 32 and the slope of shoulder 31 and strength of spring 33 are arranged so the operator can withdraw the shaft 14 from bore 12 by a sharp pull or tug on handle 16 while holding grip handle 13. This, of course, allows access to key 19 for removal and interchange thereof.

The forward end of bore 12 has an annular anvil 35 for engaging the body part of an anchor nut. As particularly contemplated in the present invention, means are provided for distributing the stresses encountered in use of tool 10 equally about the anvil 35. This is accomplished by providing a hexagonally-shaped bore 42 in the end of body member 11 receiving anvil 35 therein coaxially aligned with bore 12 and providing an hexagonally-shaped configuration to anvil 35. Of course, various flats and/or configurations may be provided in bore 42 and anvil 35 for accomplishing the same. The anvil 35 has a serrated outer face 36 for frictionally engaging the body of the anchor nut, the serrations being in the form of radial v-section ribs and grooves. The annular anvil 35 surrounds an aperture in the form of a smooth-walled bore 37 through it which is aligned coaxially with the bore 12 in the body member 11. Tool 10 also has the aforementioned interchangeable mandrel 20 positioned in bore 37 in anvil 35. Mandrel 20 has an externally threaded shaft 38 extending outwardly of anvil 35, as shown in assembled view in FIG. 2, and at its opposite end an enlarged head 39 having a hexagonally-shaped socket 40 configured as key shaft 30 of key 19. Enlarged head 39 prevents mandrel 20 from moving out through bore 37 in anvil 35. If desired, washers (not shown) may be provided between head 39 and anvil 35.

Figure 5:
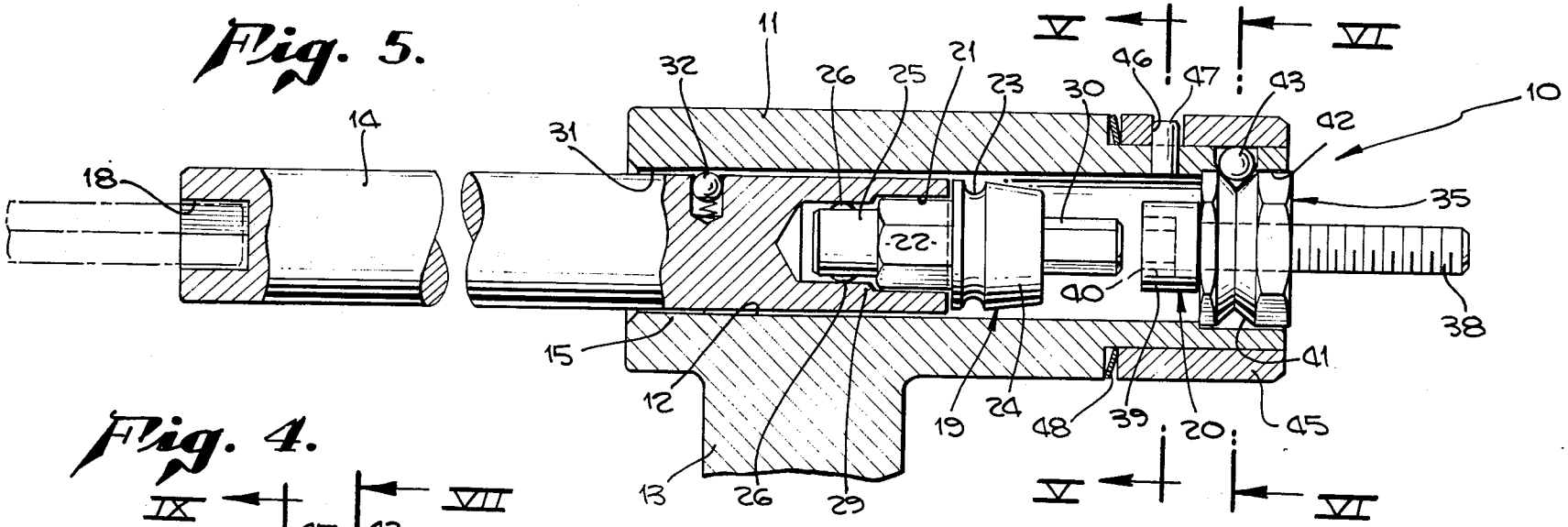
FIG. 5 is a view similar to FIG. 2 showing a second operational position of the tool.

In the assembled view of FIG. 2, hexagonal key shaft 30 fits into and drivingly engages the socket 40 on mandrel 38. As shown in FIG. 5, the shaft 14 may be pulled back from the FIG. 2 position thus disengaging key shaft 30 from socket 40. Further pull or tug on handle 16 can withdraw the shaft 14 out of bore 12 as previously discussed.

Figure 6:
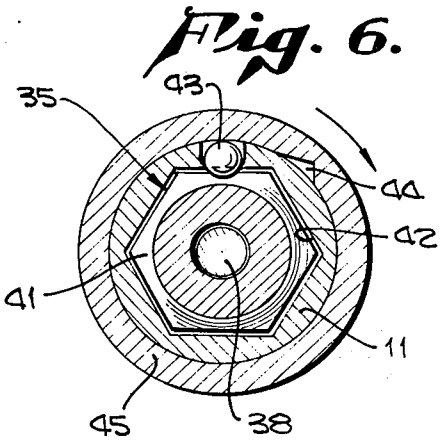
FIG. 6 is a view taken along lines VI—VI of FIG. 5 with parts thereof omitted for convenience of illustration.
Figure 7:
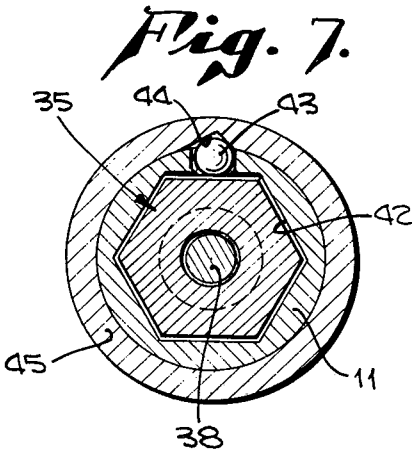
FIG. 7 is a view similar to FIG. 6 showing a second operational position of the components of the tool illustrated in FIGS. 4, 5 and 6, taken along lines VII—VII of FIG. 4.

As particularly contemplated in the present invention, means are provided for releasably retaining anvil 35 in body member 11. In the exemplary embodiment of the invention, such means includes a peripheral groove 41 on anvil 35. As shown in FIG. 6, a detent member in the form of a locking element 43 is loosely disposed in a bore in the wall of bore 42. A portion of the inner body of bore 42 is cut away at opening 44 for receiving element 43 therein. The open end of the bore receiving element 43 may be peened or staked to prevent element 43 from emerging completely therefrom. However, the dimension of locking element 43 and the dimensions of opening 44 are chosen so element 43 can enter opening 44 permitting ready insertion of anvil 35 in bore 42. FIG. 7 shows the "open" position of element 43. As shown in FIG. 1, a rotatable collar 45 is provided on body member 11 surrounding bore 42. Collar 45 rotates with respect to bore 42. A slot (FIGS. 1 and 9) is provided on the outer surface of collar 45 and receives therein a pin 47 fixedly secured to bore 42. A wave spring 48 may be provided between collar 45 and the body portion 11 for providing tension on sleeve or collar 45. By rotating collar 45, as shown in FIG. 7, element 43 enters groove 41 and cannot enter opening 44 so that it projects into bore 42. This is the closed position (FIG. 7). As shown in FIG. 2, of anvil 35 is inserted into bore 42 in the FIG. 7 position, then collar 45 rotated as in FIGS. 6 & 10, element 43 enters the peripheral groove 41 in anvil 35, as shown in FIG. 6 and prevents removal of anvil 35 therefrom. Slot 46 acts as a stop for pin 47. Of course, more tna on element 43 may be provided with suitable openings 44, if desired. It can be seen that, by rotating collar 45, pin 47 moves between opened and closed positions indicating element 43 has moved from its open of FIG. 7 position to its closed or FIGS. 2, 10 and 6 positions locking anvil 35 in position until it is desired to remove the same for easy and quick interchangeability.

Referring once again to FIG. 1, in assembling tool 10, key 19 is inserted into socket 21 and shaft 14 is inserted into bore 12. Mandrel 20 is inserted into anvil 35 with the serrated face 36 facing outwardly as in FIG. 1. Key shaft 30 enters socket 40 on mandrel 20. During the assembly, collar 45 is in the FIG. 7 position. However, collar 45 is now rotated to the FIG. 6 position thus locking anvil 35 in position.

Of course, key shaft 30 and socket 40 may be of any suitable mating configurations.

The operation of tool 10, assembled as shown in FIG. 2, is used to install anchor nuts of the type described in detail in U.S. Pat. No. 3,587,271 to Rigot, the teachings of which are incorporated herein by reference. Since FIGS. 7 and 11 describe in detail how threaded shaft 38 (threaded portion 18 in U.S. Pat. No. 3,587,271) enters the fastener shown in FIGS. 7 to 11 of the Rigot patent, further discussion is deemed unnecessary and reference should be made to U.S. Pat. No. 3,587,271 for such securing operation. In both tools of the Rigot patent and the instant application, the mandrel is closed so that its threaded portion mates with the internal threading of the anchor nut to be installed. This, of course, is the necessity for providing quick and easy means for interchanging the mandrel 20, anvil 35 and key 19 of the instant invention as heretofore described.

Also, as particularly contemplated in the present invention, means are provided for installing anchor nuts in hard-to-get-at locations. These locations are those areas where it is impossible to rotate handle 16 completely due to its tee-shaped configuration. In the exemplary embodiment, such means includes making handle 16 removable from the shaft 14 thus leaving only a tubular shaft 14 having end socket 18. A conventional socket wrench (not shown) having a key similar to socket 18 may be inserted into socket 18 and selectively rotated as is well known in the tool art.

In the device of the Rigot patent, since the handle was fixed to the shaft, in tight areas, it was necessary to withdraw the shaft and move it to a different locking position so as to be able to actuate the handle. In my tool, no selective withdrawal and reengaging of the key and mandrel is necessary.

It can be seen that I have described a tool for installing blind anchor nuts having means for quickly and easily interchanging internal components thereof without the need for external tooling so that such tool may be used on nuts of varying sizes. Further, such means does not require screws or the like which can be lost or sheared off in using the tool and the forces are equally distributed on the internal components of the tool during use.

I claim:

1. In a manually operable tool for installing blind anchor nuts by pulling an internally threaded part of the nut into a body part of the nut to expand the latter, the tool including a body member having a bore extending therethrough, an anvil at one end of the bore for engaging the body part of an anchor nut, the anvil surrounding an aperture aligned with the bore, a grip by means of which an operator can hold body member to prevent rotation thereof about the bore, an interchangeable mandrel positioned in the aperture in the anvil, the mandrel having an externally threaded portion extending outwardly of the anvil and a socket facing into the bore, a shaft rotatable and reciprocable in the bore of the body member which shaft is provided at one end with an interchangeable key which fits into the socket on the mandrel in driving engagement therewith, the shaft being provided with a handle outside the body member of the tool by means of which the shaft can be both rotated and reciprocated with respect to the body member, the shaft being reciprocable between a first position in which the key on the shaft engages in the socket on the mandrel thereby allowing rotation of the mandrel by means of the handle, and a second position in which the key disengages from the socket thereby allowing rotation of the handle without rotation of the mandrel, the improvement which comprises the provision of:

disengaging means carried by the tool for disengaging said key from said shaft without the need for external tooling for interchanging the same, said disengaging means including key releasing means on both the shaft and the key for both snap-fitting said key onto said shaft and manually removing the key from said shaft upon the application of a force on said key in a direction away from said shaft.

2. In the tool of claim 1 further including disengaging means carried by the tool for disengaging said anvil from said bore in said body member without the need for external tooling for interchanging the same, said disengaging means including anvil releasing means including a manually movable portion on said body member, said movable portion surrounding said aperture, and locking means on both said movable portion and said anvil for releasing said anvil from said bore in a first position of said movable portion and locking said anvil in said bore in a second position of said movable portion.

3. In the tool of claim 1 wherei said key releasing means includes a non-circular socket in the end of said shaft receiving said key therein, said last-mentioned socket having an annular shoulder about the inner wall thereof, and said key having a shaft having a portion thereof configured similarly to said last-mentioned socket for insertion therein, said last-mentioned shaft including a bore therethrough having spring-biased detent means extending normally beyond the outer periphery of said last-mentioned shaft when said key is removed from said shaft and movable into the bore of said last-mentioned shaft against the spring bias when said key is inserted into said last-mentioned socket until said detent means moves past said shoulder in said last-mentioned socket thereby permitting said detent means to move back to its normal position, removal of said key from said last-mentioned socket being prevented by said detent means engaging said shoulder until sufficient force of said detent means against said shoulder overcomes said spring bias thereby retracting said detent means into the bore of said last-mentioned shaft permitting withdrawal of said key out of said last-mentioned socket.

4. In the tool of claim 2 wherein said locking means includes said anvil having a peripheral groove therein and the aperture in the bore of said body member having detent means adapted to extend into said aperture, said detent means being disposed in the groove in said anvil when said anvil is present in said aperture, said movable portion being rotatable for selectively releasing said detent means for movement out of said groove when manually rotated in a first position and locking said detent means in said groove when manually rotated in a second position.

5. In the tool of claim 4 wherein said movable portion includes a rotatable sleeve surrounding said aperture in the bore of said body member, said detent means being disposed in the wall of said aperture and extending normally into said aperture, and said sleeve having a cavity for receiving said detent means therein when in said first position and a wall surface abutting against said detent means holding said detent means in said peripheral groove in said second position.

6. In the tool of claim 5 wherein said sleeve includes indexing means on the outer surface thereof for indexing the movement of said sleeve between its first and second positions.

7. In the tool of claim 5 wherein wave spring means is disposed between said sleeve and said body member for applying tension to said sleeve.

8. In the tool of claim 5 wherein said detent means is a locking element freely disposed in a bore in the wall of said aperture in the bore of said body member, the surface of said aperture in the bore of said body member surrounding said element being staked or peened to prevent exiting of said element out of said bore in the wall of the aperture of the bore of said body member.

9. In the tool of claim 5 wherein the aperture in the bore in said body member receiving said anvil therein and the outer peripheral surface of said anvil are regular polygonally-shaped so that the force on said anvil during use of said tool is substantially equally distributed to said anvil.

10. In the tool of claim 1 wherein the end of said shaft having said handle thereon terminates in a non-circular socket opening in a direction opposite to the aperture in said bore for receiving the socket of a socket wrench therein.

11. In the tool of claim 10 wherein said handle is removable from said shaft.

12. In a manually operable tool for installing blind anchor nuts by pulling an internally threaded part of the nut into a body part of the nut to expand the latter, the tool including a body member having a bore extending therethrough, an anvil at one end of the bore for engaging the body part of an anchor nut, the anvil surrounding an aperture aligned with the bore, a grip by means of which an operator can hold the body member to prevent rotation thereof about the bore, an interchangeable mandrel positioned in the aperture in the anvil, the mandrel having an externally threaded portion extending outwardly of the anvil and a socket facing into the bore, a shaft rotatable and reciprocable in the bore of the body member which shaft is provided at one end with an interchangeable key which fits into the socket on the mandrel in driving engagement therewith, the shaft being provided with a handle outside the body member of the tool by means of which the shaft can be both rotated and reciprocated with respect to the body member, the shaft being reciprocable between a first position in which the key on the shaft engages in the socket on the mandrel thereby allowing rotation of the mandrel by means of the handle, and a second position in which the key disengages from the socket thereby allowing rotation of the handle without rotation of the mandrel, the improvement which comprises the provision of:

first disengaging means carried by the tool for disengaging said key from said shaft without the need for external tooling for interchanging the same, said first disengaging means including key releasing means on both the shaft and the key for both snap-fitting said key onto said shaft and manually removing the key from said shaft upon the application of a force on said key in a direction away from said shaft; and second disengaging means carried by the tool for disengaging said anvil from said bore in said body member without the need for external tooling for interchanging the same, said second disengaging means including anvil releasing means including a manually movable portion on said body member, said movable portion surrounding said aperture, and locking means on both said movable portion and said anvil for releasing said anvil from said bore in a first position of said movable portion and locking said anvil in said bore in a second position of said movable portion.

13. In the tool of claim 12 wherein said key releasing means includes a non-circular socket in the end of said shaft receiving said key therein, said last-mentioned socket having an annular shoulder about the inner wall thereof, and said key having a shaft having a portion thereof configured similarly to said last-mentioned socket for insertion therein, said last-mentioned shaft including a bore therethrough having sring-biased detent means extending normally beyond the outer periphery of said last-mentioned shaft when said key is removed from said shaft and movable into the bore of said last-mentioned shaft against the spring bias when said key is inserted into said last-mentioned socket until said detent means moves past said shoulder in said last-mentioned socket thereby permitting said detent means to move back to its normal position, removal of said key from said last-mentioned socket being prevented by said detent means engaging said shoulder until sufficient force of said detent means against said shoulder overcomes said spring bias thereby retracting said detent means into the bore of said last-mentioned shaft permitting withdrawal of said key out of said last mentioned socket; and said locking means includes said anvil having a peripheral groove therein and the aperture in the bore of said body member having detent means adapted to extend into said aperture, said detent means being disposed in the groove in said anvil when said anvil is present in said aperture, said movable portion being rotatable for selectively releasing said detent means for movement out of said groove when in said first position and locking said detent means in said groove when in said second position.

14. A tool for installing blind anchor nuts by pulling an internally threaded part of the nut into a body part of the nut to expand the latter, the tool including:

a body member having a bore extending therethrough;

an anvil at one end of the bore for engaging the body part of an anchor nut, the anvil surrounding an aperture aligned with the bore;

a grip by means of which an operator can hold said body member to prevent rotation thereof about the bore;

an interchangeble mandrel positioned in the aperture in the anvil, the mandrel having an externally threaded portion extending outwardly of the anvil and a socket facing into the bore;

a shaft rotatable and axially movable in the bore of the body member which shaft is provided at one end with an interchangeable key which fits into the socket on the mandrel in driving engagement therewith; shaft rotating means associated with the shaft for rotating the shaft with respect to the body member, the shaft being movable between a first position in which the key on the shaft engages in the socket on the mandrel, and a second position in which the key disengages from the socket; and:

disengaging means carried by the tool for disengaging said key from said shaft without the need for external tooling for interchanging the same, said disengaging means including key releasing means on both the shaft and the key for both snap-fitting said key onto said shaft and manually removing the key from said shaft upon the application of a force on said key in a direction away from said shaft.

15. In the tool of claim 14 further including disengaging means carried by the tool for disengaging said anvil from said bore in said body member without the need for external tooling for interchanging the same, said disengaging means including anvil releasing means including a manually movable portion on said body member, said movable portion surrounding said aperture, and locking means on both said movable portion and said anvil for locking said anvil in said bore in a first position of said rotatable portion and releasing said anvil from said bore in a second portion of said movable portion.

16. In the tool of claim 14 wherein said key releasing means includes a non-circular socket in the end of said shaft receiving said key therein, said last-mentioned socket having an annular shoulder about the inner wall thereof, and said key having a shaft having a portion thereof configured similarly to said last-mentioned socket for insertion therein, said last-mentioned shaft including a bore therethrough having spring-biased detent means extending normally beyond the outer periphery of said last-mentioned shaft when said key is removed from said shaft and movable into the bore of said last-mentioned shaft against the spring bias when said key is inserted into said last-mentioned socket until said detent means moves past said shoulder in said last-mentioned socket thereby permitting said detent means to move back to its normal position, removal of said key from said last-mentioned socket being prevented by said detent means engaging said shoulder until sufficient force of said detent means against said shoulder overcomes said spring bias thereby retracting said detent means into the bore of said last-mentioned shaft permitting withdrawal of said key out of said last-mentioned socket.

17. In the tool of claim 14 wherein said locking means included said anvil having a peripheral groove therein and the aperture in the bore of said body member having detent means adapted to extend into said aperture, said detent means being disposed in the groove in said anvil when said anvil is present in said aperture, said movable portion being rotatable for selectively releasing said detent means for movement out of said groove when manually rotated in a first position and locking said detent means in said groove when in a second position.

* * * * *